US012252891B1

(12) United States Patent
Morris

(10) Patent No.: US 12,252,891 B1
(45) Date of Patent: Mar. 18, 2025

(54) DECK FASTENERS ALIGNMENT TOOL

(71) Applicant: Brian Morris, Webb City, MO (US)

(72) Inventor: Brian Morris, Webb City, MO (US)

( * ) Notice: Subject to any disclaimer, the term of this patent is extended or adjusted under 35 U.S.C. 154(b) by 0 days.

(21) Appl. No.: 18/742,342

(22) Filed: Jun. 13, 2024

(51) Int. Cl.
*E04G 21/18* (2006.01)

(52) U.S. Cl.
CPC ..... *E04G 21/1883* (2013.01)

(58) Field of Classification Search
CPC ... E04G 21/18; E04G 21/1841; E04G 21/185; E04G 21/1883; E04G 21/1891; B25B 23/005; B25B 23/08; B25B 23/12; E04F 15/02183; E04F 21/0092; E04F 21/22
USPC ..... 33/526; 52/749.1
See application file for complete search history.

(56) References Cited

U.S. PATENT DOCUMENTS 915,982 A * 3/1909 Maddux ..... E04G 21/1841 33/518
2,585,283 A * 2/1952 Sommers ..... E04G 21/1841 33/410
2,911,022 A * 11/1959 Brown ..... B25B 5/142 269/1
4,930,225 A * 6/1990 Phillips ..... E04F 21/0076 33/526
4,955,142 A * 9/1990 Rieck ..... E04F 21/0092 33/645
5,964,073 A * 10/1999 Harper ..... E04G 21/20 52/DIG. 1
5,971,361 A * 10/1999 Heimbach ..... E04F 21/22 254/16
6,243,961 B1 * 6/2001 Winski ..... B25H 7/00 33/526
6,539,641 B2 * 4/2003 Belliveau ..... E04G 21/1891 33/645
D613,593 S * 4/2010 King ..... D8/382
D668,562 S * 10/2012 Madrack ..... D15/138
8,434,738 B1 * 5/2013 Anstett ..... E04F 21/22 254/12
D704,018 S * 5/2014 Vandenberg ..... D8/51
8,793,889 B2 * 8/2014 Hovren ..... E04G 21/1891 33/526

(Continued)

FOREIGN PATENT DOCUMENTS

CA 3080666 A1 * 11/2020 ..... E04B 2/58
CA 3129520 A1 * 3/2022 ..... B25B 23/005

(Continued)

*Primary Examiner* — Ryan D Kwiecinski
(74) *Attorney, Agent, or Firm* — Dale J. Ream

(57) ABSTRACT

A deck fasteners alignment tool enables accurate positioning of deck boards before being fastened to respective deck joists. The alignment tool includes or defines a pair of V-shaped recesses on a template body which provides proper alignment to deck fasteners so long as outer locating pins are aligned with laterally adjacent gaps between deck boards, respectively. The alignment tool includes a pair of internally positioned neodymium magnets adjacent the alignment recesses for magnetically holding deck board screws in a perpendicular or upstanding position so that the screws may be driven single-handedly by the person building the deck. In addition, some embodiments provide the alignment tool with laterally adjustable V-shaped recesses for selectively aligning deck fasteners into laterally adjacent ribs of the deck boards, respectively.

18 Claims, 10 Drawing Sheets

(56) References Cited

U.S. PATENT DOCUMENTS 8,881,419 B2 * 11/2014 Madrack ..... E04F 21/22 33/645
8,931,237 B2 * 1/2015 Kloepfer ..... E04F 21/22 52/DIG. 1
8,955,210 B2 * 2/2015 Vandenberg ..... B25B 23/00 173/1
9,216,847 B2 * 12/2015 Belinda ..... B23B 47/287
D782,264 S * 3/2017 Erdman ..... D8/71
10,676,941 B1 * 6/2020 Hoffman ..... E04F 19/0436
10,895,080 B1 * 1/2021 MacKenzie ..... E04F 15/02044
10,988,947 B2 * 4/2021 Sheppard ..... G01C 9/34
D988,831 S * 6/2023 Mikkelsen ..... D8/71
11,802,413 B2 * 10/2023 Gillis ..... E04F 21/22
11,819,122 B2 * 11/2023 Tarpey ..... E04H 12/2269
D1,011,256 S * 1/2024 Friis ..... D8/68
11,938,596 B1 * 3/2024 Vandenberg ..... B25B 23/005
2003/0221391 A1 * 12/2003 Bolton ..... B25B 23/00 52/741.1
2005/0278934 A1 * 12/2005 Orchard ..... B25B 11/02 29/799
2009/0001642 A1 * 1/2009 Bolton ..... E04F 21/22 411/383
2010/0083610 A1 * 4/2010 King ..... B25B 15/001 52/749.1
2012/0085065 A1 * 4/2012 Gelormino ..... E04F 21/22 52/749.1
2012/0131881 A1 * 5/2012 Pham ..... E04F 21/0092 52/749.11
2012/0204409 A1 * 8/2012 Vandenberg ..... F16B 25/0073 29/271
2013/0048926 A1 * 2/2013 Lehmann ..... B25B 5/12 254/17
2013/0174498 A1 * 7/2013 Hovren ..... E04F 21/22 52/749.1
2013/0306633 A1 * 11/2013 Belinda ..... B25H 7/00 33/562
2014/0223755 A1 * 8/2014 Madrack ..... E04F 21/0092 33/645
2015/0321325 A1 * 11/2015 Vandenberg ..... E04F 21/22 81/57.37
2016/0052110 A1 * 2/2016 Erdman ..... B25B 27/00 29/271
2019/0105764 A1 * 4/2019 Dembeck ..... B25B 31/00
2019/0257099 A1 * 8/2019 Erdman ..... B25B 11/00
2020/0011073 A1 * 1/2020 Sheppard ..... B25B 23/005
2020/0263441 A1 * 8/2020 Miller ..... B23Q 9/0078
2021/0054636 A1 * 2/2021 Gillis ..... E04F 15/02183
2022/0072687 A1 * 3/2022 Friis ..... B25B 5/145
2023/0349179 A1 * 11/2023 Bradley ..... E04G 21/12
2024/0200339 A1 * 6/2024 Simonin ..... E04F 13/0803

FOREIGN PATENT DOCUMENTS

EP 3517234 A1 * 7/2019
FR 2805840 A1 * 9/2001 ..... E04F 21/0015
GB 2560166 A * 9/2018 ..... B25B 23/005
WO WO-03089186 A1 * 10/2003 ..... B25B 23/00
WO WO-2005047620 A1 * 5/2005 ..... E04F 21/0092
WO WO-2005090005 A1 * 9/2005 ..... B25B 11/02
WO WO-2013105273 A1 * 7/2013 ..... B05C 17/10

* cited by examiner

DECK FASTENERS ALIGNMENT TOOL

BACKGROUND OF THE INVENTION

This invention relates generally to deck construction and, more particularly, to a deck fasteners alignment tool that properly positions insertion of decking screws and enables insertion thereof with only a single hand.

Building a deck has long been a labor-intensive process, fraught with numerous challenges that can compromise both the efficiency and the quality of the final product. Traditional deck building methods often involve several steps that require meticulous measurement, alignment, and adjustment. These methods typically rely on manual measurement, which naturally involves human error and can result in inconsistent gaps between boards, misaligned screws, and increased material waste. Even the use of spacers does not completely remedy these issues. In some cases, these issues lead to functional, structural, and aesthetic deficiencies, such as uneven surfaces and loose or splitting boards. For these reasons, traditional deck building is heavily reliant on the skill and experience of the builder. Inexperienced builders often produce inconsistent results and fail to meet professional standards. Even capable, experienced builders must repeatedly measure and recheck alignments, slowing down the construction process and increasing labor costs.

These problems, as universal as they are to traditional deck making, could be effectively addressed through the use of a deck fasteners alignment tool with innovative features such as laterally spaced and rearward extending alignment pins and V-shaped notches for screw placement. Such a tool would have several advantages over current methods. First, it would provide a template for consistent spacing between boards, thus eliminating the guesswork and variability associated with manual spacing and resulting in a more uniform and professional appearance. Second, it would ensure that screws are consistently positioned directly over the joists, enhancing the structural integrity and longevity of the deck. Third, it would significantly reduce the time required for aligning and adjusting each board. Fourth, it would allow less experienced builders to produce better, higher-quality results. And fifth, it lessens the likelihood of errors leading to material waste, which can be frustrating and expensive, especially for small businesses and private homeowners.

Therefore, it would be desirable to have a deck fasteners alignment tool for accurately positioning deck boards before being fastened to respective deck joists. Further, it would be desirable to have an alignment tool having a pair of pre-shaped recesses on a template body which provides proper alignment to deck fasteners so long as outer locating pins are aligned with laterally adjacent gaps between deck boards, respectively. Still further, it would be desirable to have an alignment tool having a pair of internally positioned neodymium magnets positioned to hold deck board screws in a perpendicular or upstanding position so that the screws may be driven single-handedly by the person building the deck. In addition, some embodiments provide the alignment tool with laterally adjustable V-shaped recesses for selectively aligning deck fasteners into laterally adjacent ribs of the deck boards, respectively.

SUMMARY OF THE INVENTION

The deck fasteners alignment tool according to the present invention includes a body with opposed ends, an upper and lower edge, and front and rear faces that, together, present a generally rectangular and planar configuration. Integrated into the body are a pair of laterally opposed alignment pins (i.e., locator pins) extending rearwardly from the rear face. These alignment pins are engineered to interface with the gaps between laterally adjacent decking boards until contact is made with a deck joist, so that decking fasteners (such as screws) may be aligned before being driven into corresponding decking boards. In an embodiment, the alignment pins may be laterally and slidably movable to account for small variations in a distance between laterally adjacent gaps between respective decking boards.

Moreover, the upper edge of the body defines a pair of V-shaped notches, strategically positioned adjacent one another so as to guide and align the insertion of deck board screws into a respective deck board. Specifically, the intersection of the descending walls of each V-shaped notch converge or intersect at the precise location where a decking fastener should be inserted. The configuration of the body enhances the efficiency and accuracy of the deck construction process, ensuring proper alignment and placement of fasteners. In an embodiment, the V-shaped notches may be slidably movable along a slot so as to be compatible with deck boards of various dimensions, respectively.

Further, a pair of neodymium magnets may be embedded in the body closely proximate the tip of the V-shaped notches, respectively. Each magnet has sufficient magnetic attraction to hold a deck screw in an upstanding or vertical configuration such that the screw may be driven into the respective decking board with only single-handed operation of the deck builder, e.g. homeowner, contractor, or handyman.

In summary, the deck fasteners alignment tool offers a comprehensive solution for aligning decking boards and facilitating the insertion of deck board screws, thereby streamlining the deck construction process and enhancing overall construction quality.

Therefore, a general object of this invention is to provide an alignment tool having a pair of rearwardly extending locating pins configured for insertion in laterally adjacent gaps between decking boards and into contact with a respective joist so as to align V-shaped recesses to ensure proper positioning of deck securing fasteners.

Another object of this invention is to provide a deck fasteners alignment tool, as aforesaid, having a pair of neodymium magnets configured to hold deck screws in an upright configuration so that they can be driven more conveniently by a deck builder.

Still another object of this invention is to provide a deck fasteners alignment tool as aforesaid, that is laterally adjustable to accommodate different sizes of deck boards.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
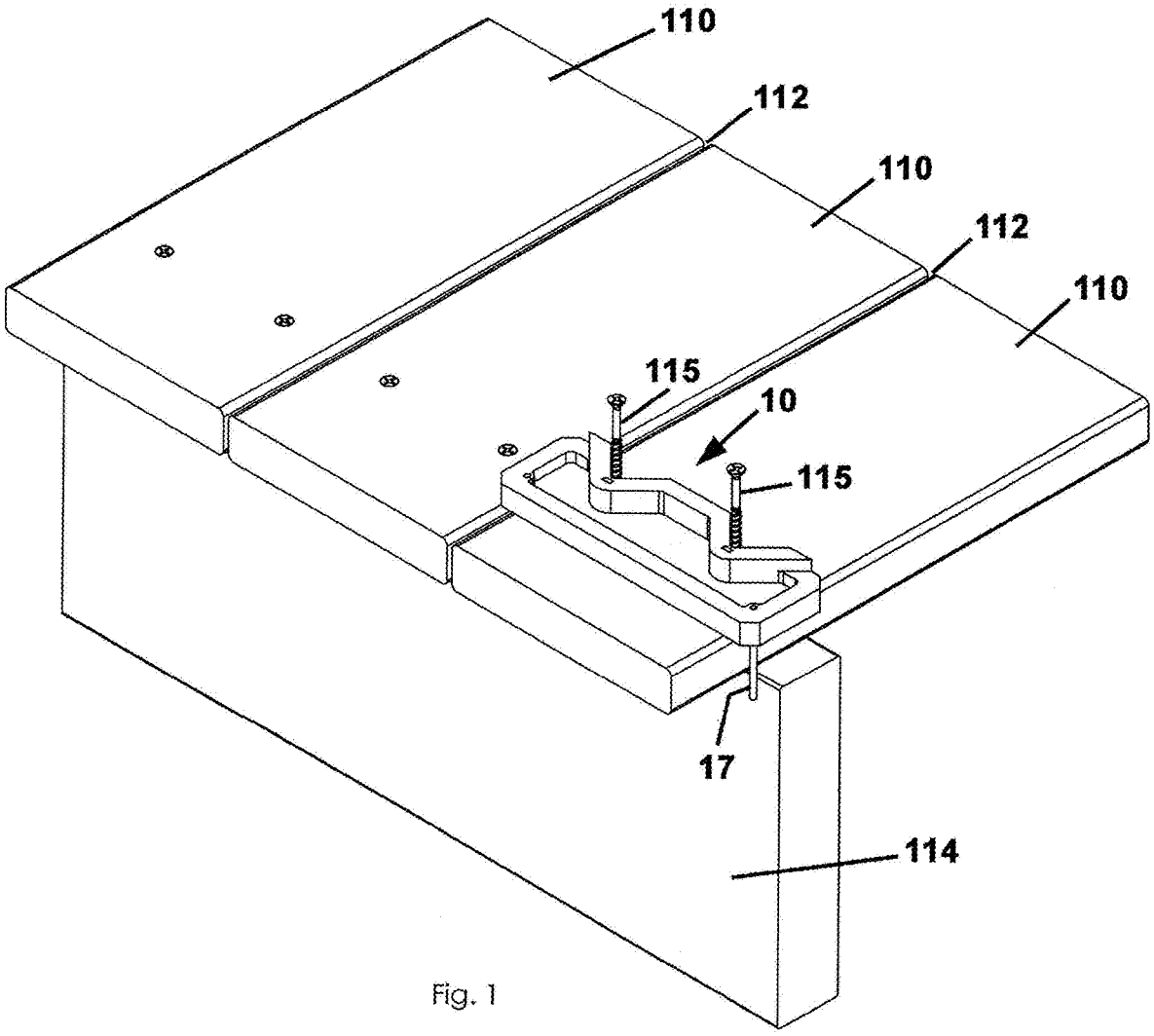
FIG. 1 is a perspective view of a deck fasteners alignment tool according to a preferred embodiment of the present invention, illustrated in use in the construction of a residential deck.
Figure 2A:
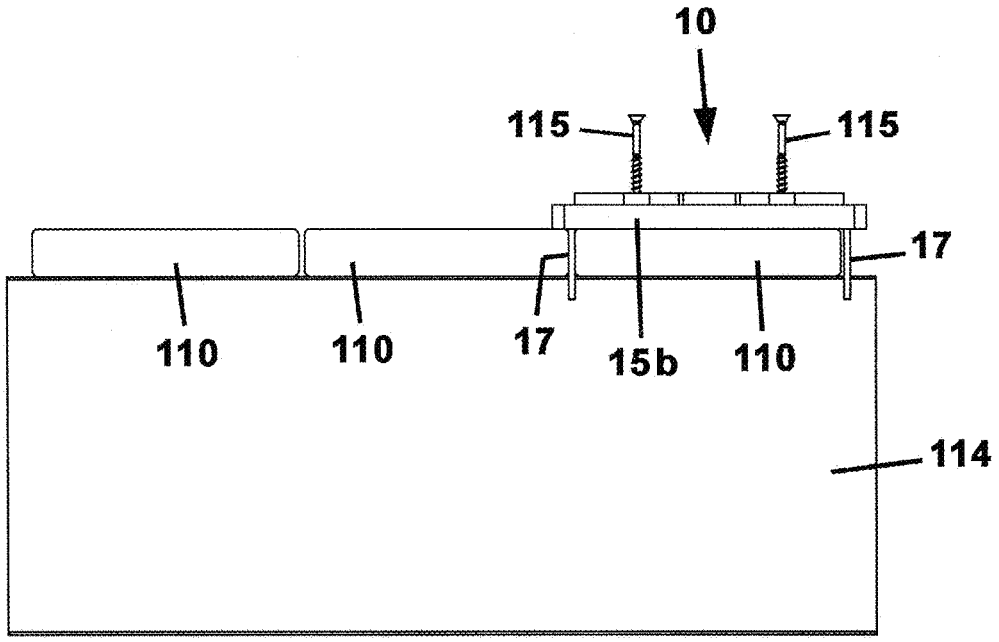
FIG. 2*a* is an end view of the alignment tool as in FIG. 1, illustrated being used in construction of a deck.
Figure 2B:
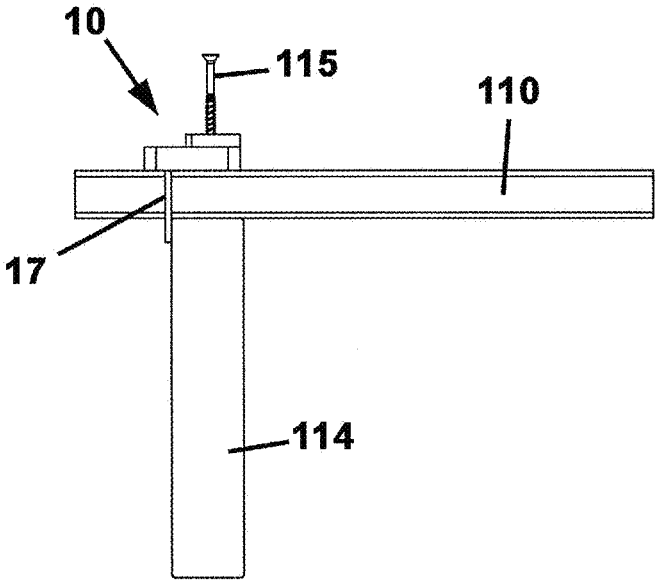
FIG. 2*b* is a side view of the alignment tool as in FIG. 1, illustrated being used in construction of a deck.
Figure 3A:
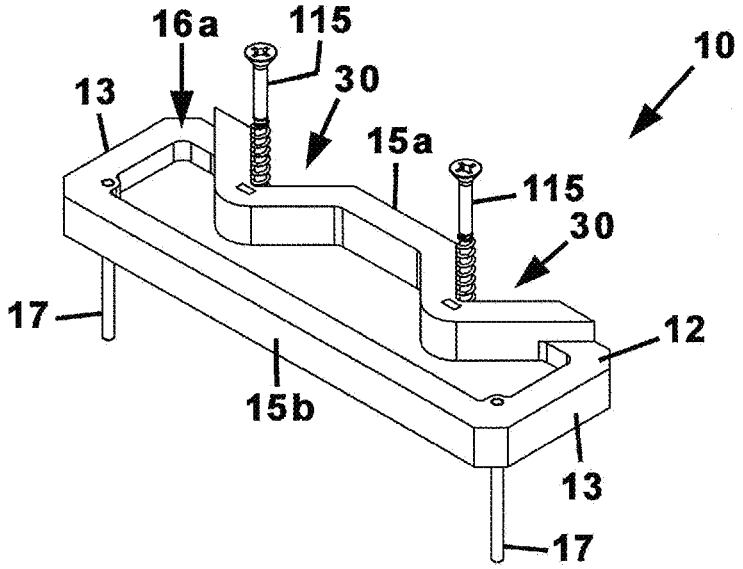
FIG. 3*a* is an isolated view of the alignment tool removed from the deck construction as in FIG. 1.
Figure 3B:
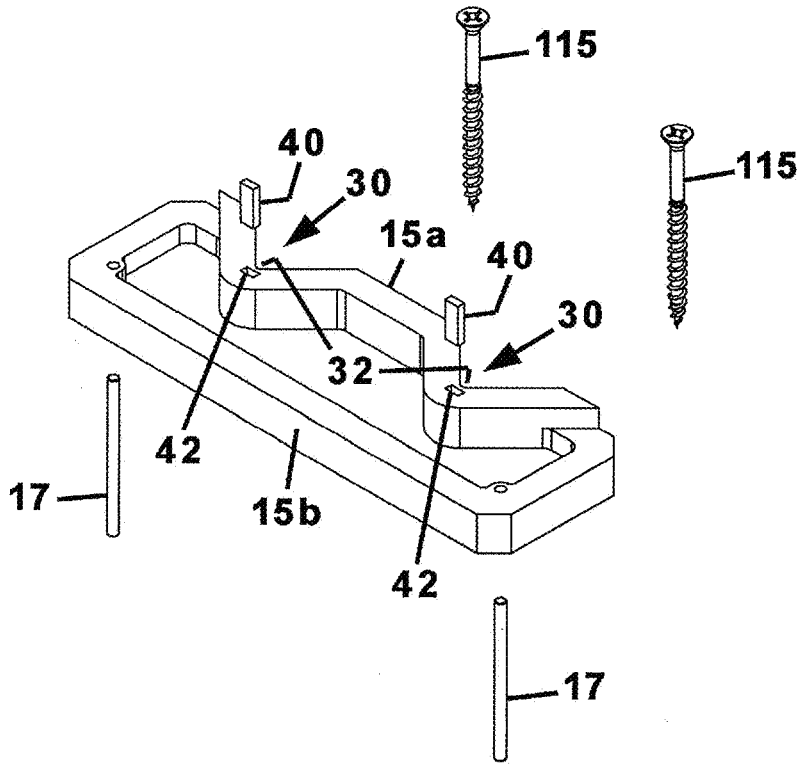
FIG. 3*b* is an exploded view of the alignment tool as in FIG. 3*a;*
Figure 4:
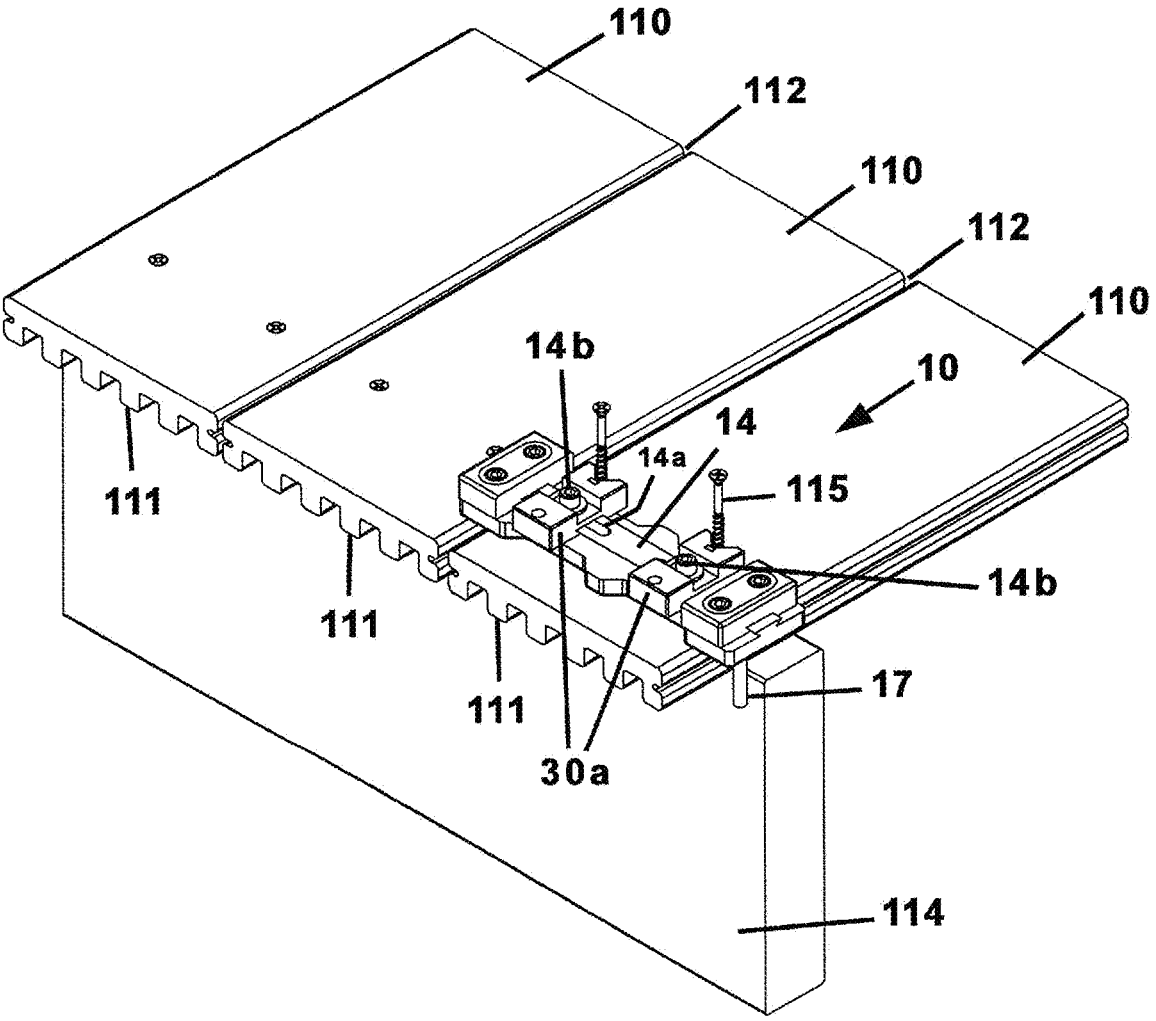
FIG. 4 is a perspective view of a deck fasteners alignment tool according to another embodiment of the present invention, illustrating the use of adjustable notch blocks.
Figure 5:
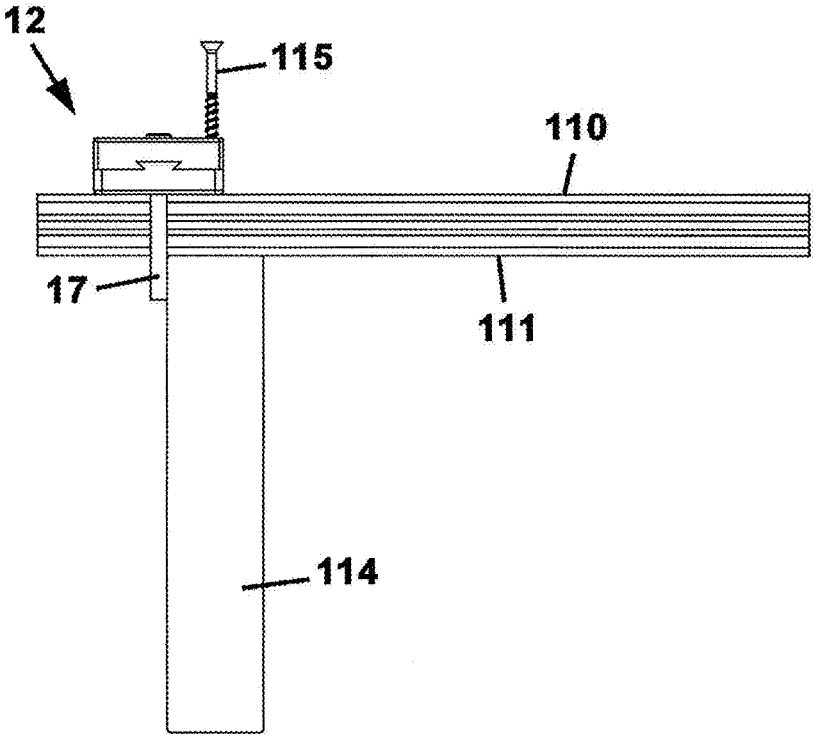
FIG. 5 is a side view of the deck fasteners alignment tool as in FIG. 4.
Figure 6A:
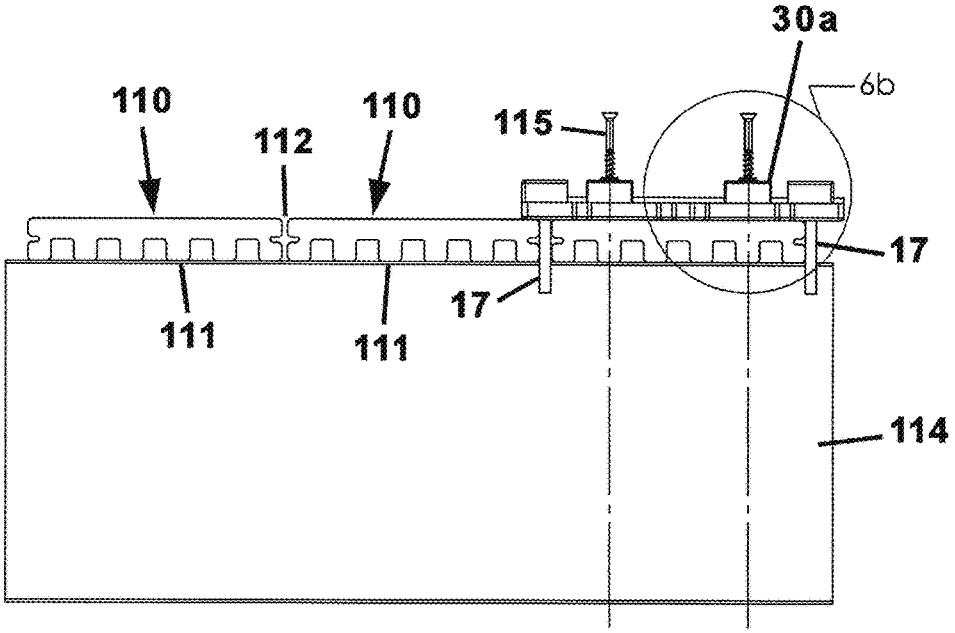
FIG. 6*a* is an end view of the deck fasteners alignment tool as in FIG. 4.
Figure 6B:
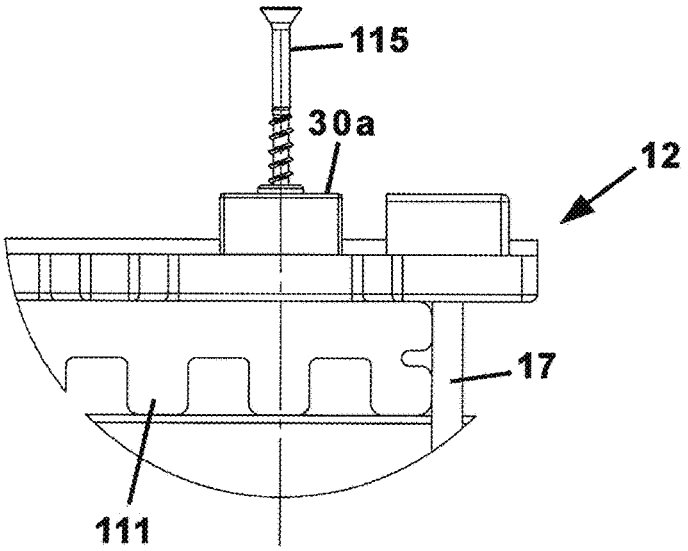
FIG. 6*b* is an isolated view taken from FIG. 6*a;*

A deck fasteners alignment tool according to a preferred embodiment of the present invention will now be described with reference to the accompanying drawings. The deck fasteners alignment tool 10 includes a body 12 having a pair of alignment pins 20, a pair of V-shaped alignment notches 30, and a pair of neodymium magnets 40 embedded in the body 12.

The alignment tool 10 includes a body 12 having opposed end portions 13 and a bridge 14 extending linearly between the end portions 13. Further, the end portions 13 and bridge 14 share an upper peripheral edge 15*a* and a lower peripheral edge 15*b* opposite the upper peripheral edge 15*a*. Preferably, the upper 15*a* and lower 15*b* peripheral edges are generally parallel one to the other. In addition, the alignment tool 10 may include a front face 16*a* having a generally planar configuration and a rear face opposite the front face. Accordingly, the alignment tool 10 may define a generally rectangular and planar configuration that may lay flat atop the face of a deck board 110 used in deck construction (FIG. 1).

Preferably, the body 12 is constructed using a durable material that is resistive to corrosion as may be common with repeated usage in an outdoor environment. Corrosion is a natural process that occurs when a material reacts with its environment—such as air, water, or other substances—and its properties and structural integrity deteriorate. Corrosion-resistant materials are designed to resist this process, either via a protective layer on the surface or through a chemical composition that does not react with the environment. Examples of corrosion-resistant materials include stainless steel, aluminum, titanium, and some plastic materials. These materials are commonly used where durability, longevity, and safety are critical, such as in construction, infrastructure, and transportation.

The alignment tool 10 includes a pair of laterally opposed alignment pins 17 proximate said end portions, respectively, each having a first end coupled to or integrated into the rear face 16*b* and extending rearwardly to a second or free end 17*a*. Stated another way, each alignment pin 17 is perpendicular to the rear face 16*b* and extends away. Each alignment pin 17 has a configuration complementary to the elongate and linear gaps 112 between adjacent deck boards 110 being used to construct a deck 100. As will be described later in more detail, the alignment pins 17, when inserted into respective gaps 112 and placed adjacent (preferably in contact with) a deck joist 114 (which is positioned perpendicular to the deck boards 110), are configured to identify a proper position for insertion of deck fasteners 115 such as deck screws whereby to fasten a deck board 110 to the deck joist 114.

According to another critical aspect, the upper peripheral edge 15*a* defines at least one and, preferably, two V-shaped alignment notches 30, the alignment notches 30 also being referred to as alignment recesses or notch blocks. More particularly, the alignment notches 30 are cut out of the upper peripheral edge 15*a*, each alignment notch having laterally spaced apart side edges converging downwardly to a lower extent (referred to as the convergent area 32). When the alignment pins 17 are properly inserted in adjacent gaps 112 so as to bear against a respective joist 114, the convergent area 32 identifies a proper placement of a deck fastener 115 such that the deck fastener 115, when inserted, will couple a respective deck board 110 to a deck joist 114. In an important aspect, the convergent area 32 has a configuration that is complementary to a shape and size of a respective deck fastener 115, i.e., to a deck board screw. Preferably, a deck builder is able to identify by a sense of touch or feel where respective sidewalls of a V-shaped notch intersect, i.e., a convergent area 32, for the sake of properly positioning a fastener.

In another aspect, the alignment tool 10 may include a pair of neodymium magnets 40 each being positioned within an interior area of the bridge 14 adjacent convergent areas 32 of respective alignment notches 30. In an embodiment, the magnets are essentially sandwiched between the front and rear faces of the body 12. In an embodiment, internal structures of the body and bridge may define interior areas or pockets 42 into which respective neodymium magnets 40 may be nested or removably received. Neodymium magnets are the strongest permanent magnets commercially available anywhere in the world. They provide unparalleled levels of magnetism and resistance to demagnetization when compared to ferrite, alnico, and even samarium-cobalt magnets. Accordingly, the neodymium magnets 40 are critical for use in the present invention and are thus distinguishable over any other similar alignment tool incorporating a lesser type of magnet. The neodymium magnets are specifically configured to hold deck fasteners 115 in an upright or upstanding configuration when positioned at a convergent area 32, respectively. In an embodiment, the neodymium magnets 40 may be positioned at an angle within their position inside the body 12 so as to maximize magnetic attraction on deck fasteners 15. Thus, each deck fastener 32 may be driven into a respective deck board 110 using a screw gun or screwdriver being operated with a single human hand. This is important in that the deck builder's other hand is free to hold the alignment tool 10 in position. In other words, the deck tool 10 must be in proper position relative to adjacent gaps 112 and joist 114 in order that the deck fasteners 115 are properly inserted through a respective deck board 110 and into said joist 114.

Figure 7A:
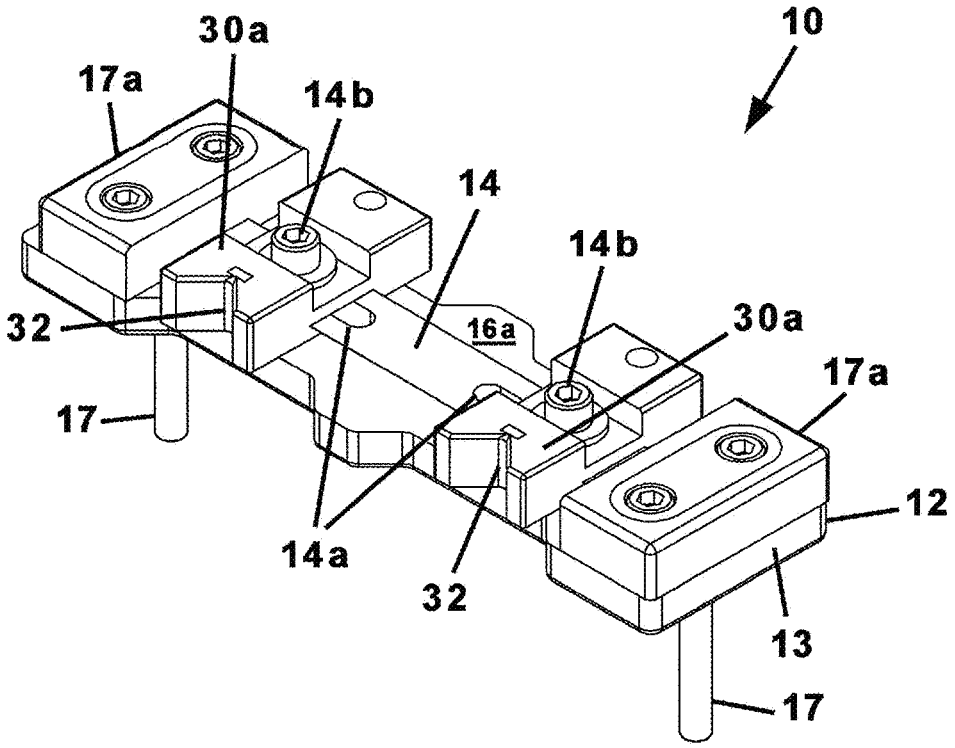
FIG. 7*a* is an elevated perspective view of the alignment tool as in FIG. 4, illustrating the adjustable notch blocks in a widened configuration.
Figure 7B:
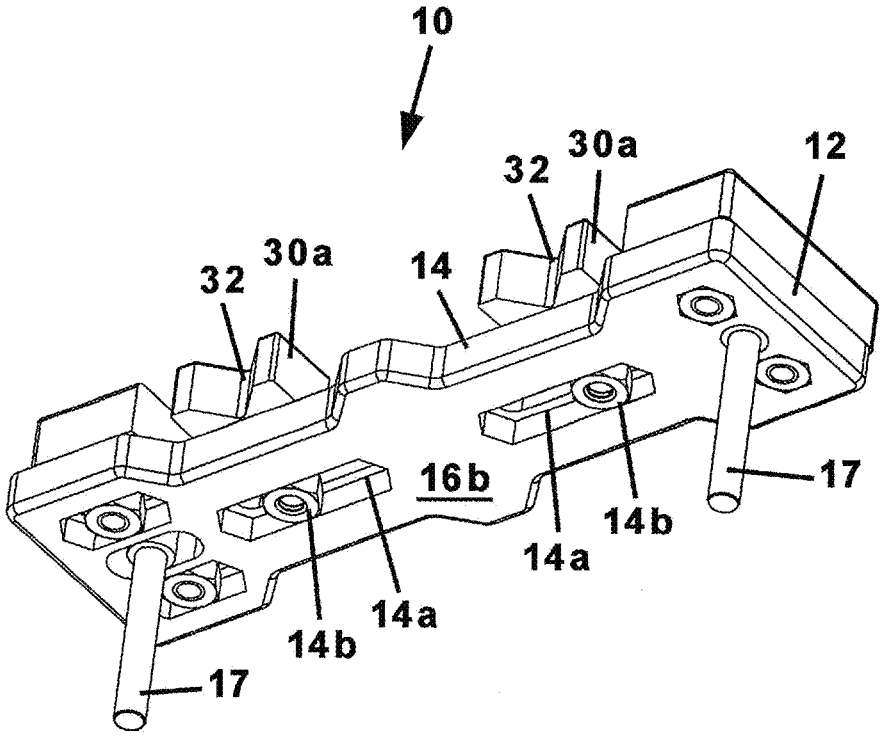
FIG. 7*b* is a perspective view from a lower angle of the alignment tool as in FIG. 7*a;*
Figure 8:
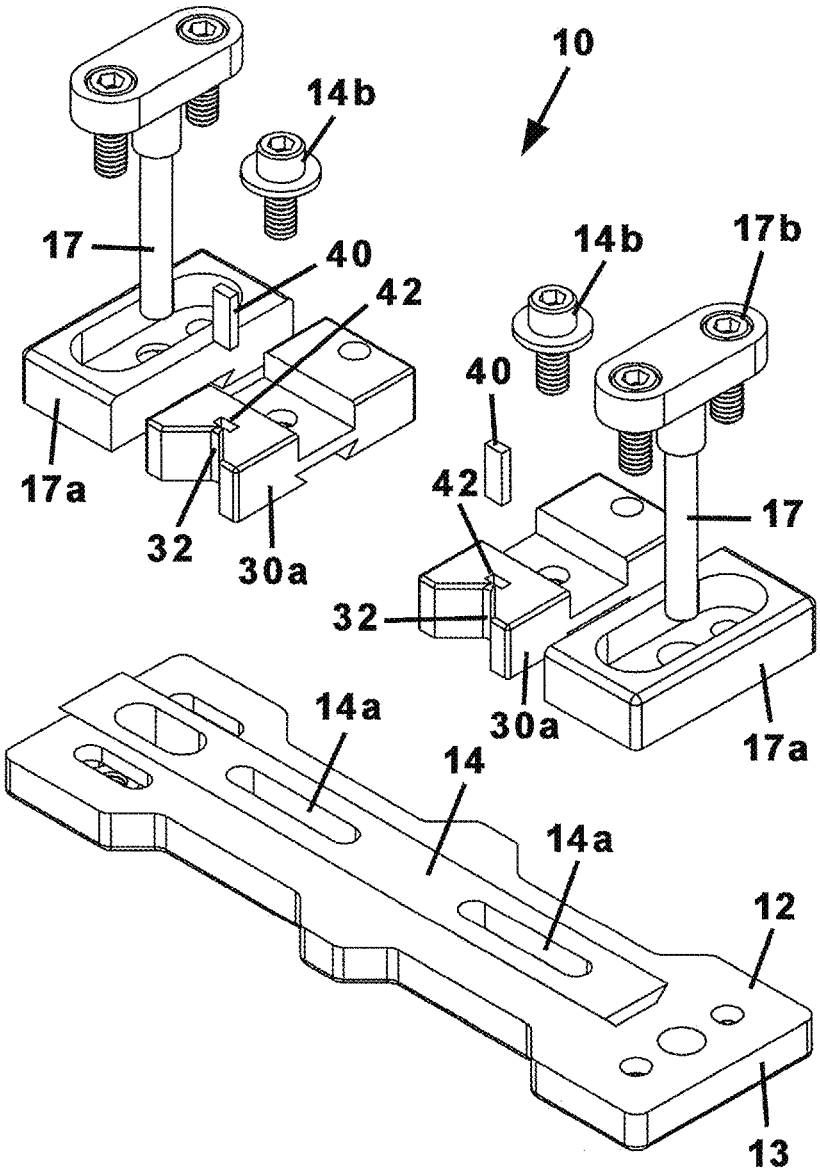
FIG. 8 is an exploded view of the alignment tool as in FIG. 7*a;*
Figure 9A:
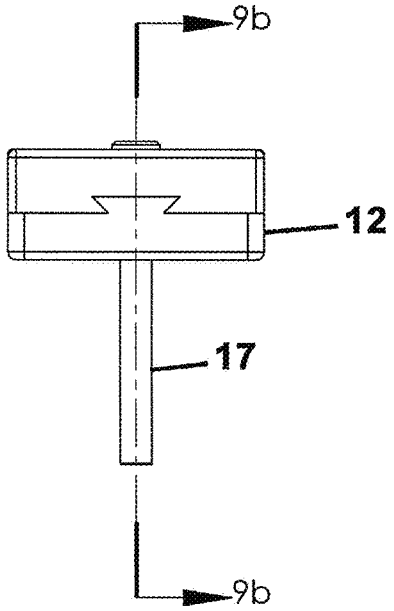
FIG. 9*a* is an end view of the alignment tool as in FIG. 7*a;*
Figure 9B:
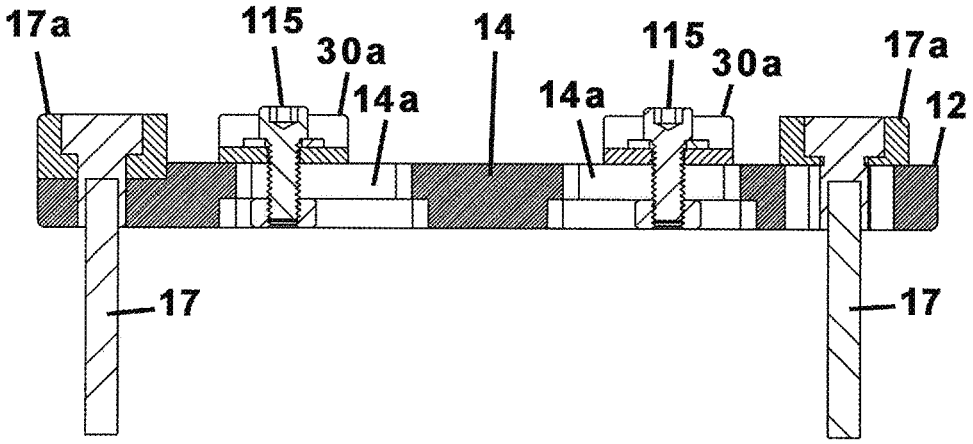
FIG. 9*b* is a sectional view taken along line 9*b*-9*b* of FIG. 9*a;*
Figure 10A:
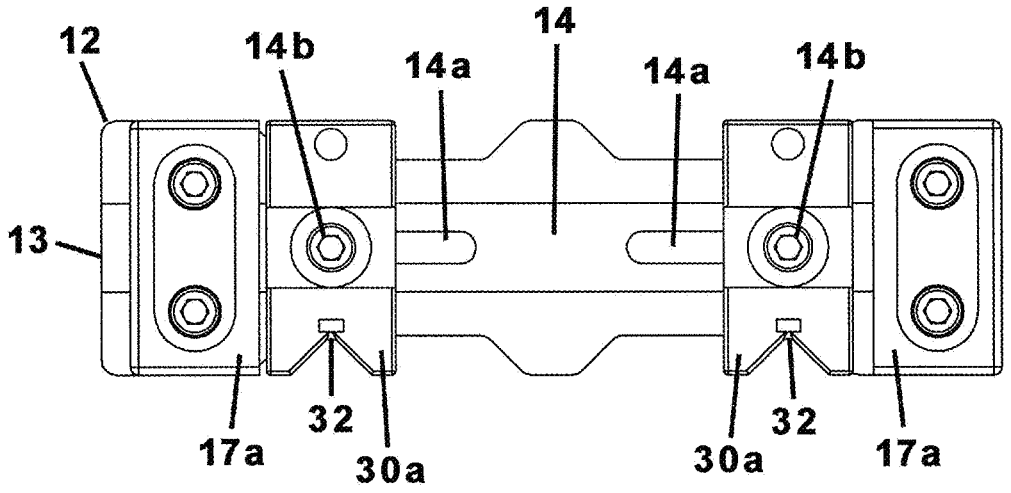
FIG. 10*a* is a top view of the alignment tool as in FIG. 7*a*, illustrating the adjustable notch blocks in a widened configuration.
Figure 10B:
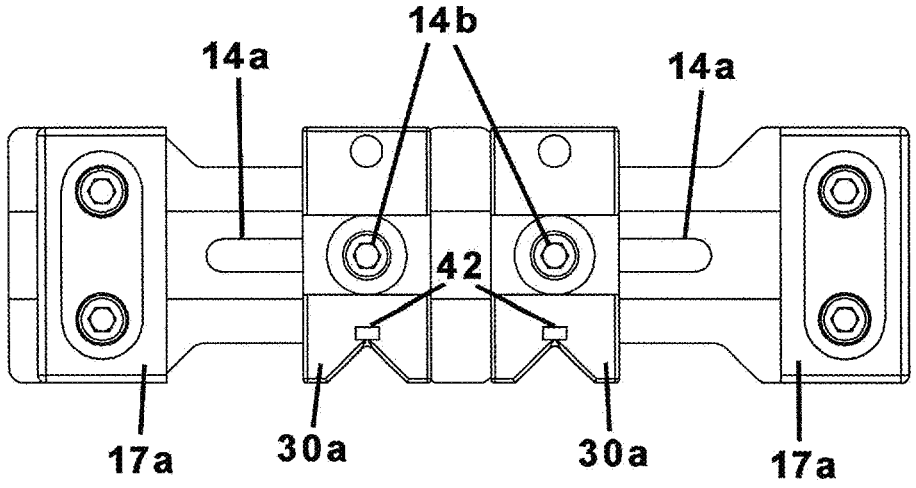
FIG. 10*b* is a top view of the alignment tool as in FIG. 7*a*, illustrating the adjustable notch blocks in a shortened configuration.

In an embodiment, the pair of alignment notches 30 may be laterally and slidably adjustable in real time so as to accommodate deck boards of various width. In other words, if a deck board is a traditional 5½ inches wide or only 3 inches wide or 4 inches wide, the alignment notches 30 may be independent structures 30*a* (referred to as notch members 30*a* or notch blocks) that are slidably movable along a slot 14*a* defined by the bridge 14 (FIG. 7*a*). To tighten or loosen the independent V-shaped structures, the independent structures 30*a* may include screw/nut combinations 30*b*. Similarly, the alignment pins 17 may be adjustably or removably mounted to the body member 12 using independent structures referred to as pin blocks 17*a*, each pin block 17*a* being releasably connected with fasteners 17*b*.

In modern deck construction, there is a configuration of deck boards that demonstrate the importance and novelty of the present invention. More particularly, a deck board 110 may include a bottom side having a plurality of ribs 111, each one of the plurality of ribs being parallel to one another and each having an elongate and longitudinal configuration (FIGS. 4 to 6*b*). Accordingly, it is of high importance that deck fasteners 115 be properly aligned for insertion into a topside of this type of deck board 110 so that the respective fastener is inserted through corresponding ribs and then joist. As shown, proper alignment is possible by the predetermined positioning of respective V-shaped notches 30 or properly spaced apart notch members 30*a* as described above.

In deck construction, there are a few scenarios where proper attachment of deck boards is problematic, i.e., more difficult to properly place and secure or to become properly aligned. One such instance is placement of a first deck board or placement of a deck board near a wall. In such scenarios, there may not be a pair of laterally adjacent deck gaps 112 into which the pair of alignment pins 17 may be inserted. In an embodiment, the lower edge of the body 12 may include a lip or shoulder having a configuration complementary to that of a side edge of a deck board 110. In other words, the body 12 is configured to properly align with a deck board 110 rather than extending between adjacent deck gaps 112 which was first described above. In short, the lip or shoulder enables alignment of deck fasteners when deck boards are positioned immediately adjacent a wall of a house or at the initiation of deck construction before adjacent deck gaps 112 are available.

It is understood that while certain forms of this invention have been illustrated and described, it is not limited thereto except insofar as such limitations are included in the following claims and allowable functional equivalents thereof.

The invention claimed is:

1. A deck fasteners alignment tool for use in construction of a deck using a plurality of deck boards spaced apart from one another so as to define laterally adjacent decking gaps therebetween, respectively, said deck fasteners alignment tool comprising:

a body having (a) opposed ends, (b) an upper edge and a lower edge extending between said opposed ends, and (c) a front face and a rear face opposite and parallel to said front face such that said body has a generally rectangular and planar configuration;

a pair of laterally opposed alignment pins integrated into the body and extending rearwardly from said rear face, each alignment pin being configured to interface with said laterally adjacent decking gaps, respectively, so as to align the body; and wherein said upper edge of said body defines a pair of V-shaped notches, each notch being configured to align and guide insertion of deck board screws into respective deck boards of the deck.

2. The deck fasteners alignment tool as in claim 1 further comprising a pair of neodymium magnets embedded in an interior area of the body, each magnet being positioned proximate to one of said notches and configured to magnetically hold the deck board screws in an upright configuration ready for insertion.

3. The deck fasteners alignment tool as in claim 2, wherein said body includes a bridge extending between said opposed ends and defining a slot having a linear configuration.

4. The deck fasteners alignment tool as in claim 3, further comprising a pair of V-shaped notches each being coupled to said bridge and being slidably and laterally movable along said slot.

5. The deck fasteners alignment tool as in claim 4, wherein each notch includes a pair of descending edges that intersect to define a convergent area.

6. The deck fasteners alignment tool as in claim 5, wherein each neodymium magnet is mounted adjacent said convergent area.

7. The deck fasteners alignment tool as in claim 6, wherein said pair of neodymium magnets are removably mounted in receiver pockets adjacent said convergent areas, respectively.

8. The deck fasteners alignment tool of claim 2, wherein said body defines a pair of pockets between said front and rear faces, said pair of neodymium magnets being situated to nest in said pair of pockets, respectively.

9. The deck fasteners alignment tool of claim 2, wherein said pair of neodymium magnets are positioned at an angle within the body so as to maximize magnetic attraction to respective deck fasteners.

10. The deck fasteners alignment tool of claim 1, wherein the alignment pins are spaced apart at predetermined distances from one another.

11. The deck fasteners alignment tool of claim 1, wherein said V-shaped notches are sized and shaped to correspond to the size and shape of the deck board screws.

12. The deck fasteners alignment tool of claim 1, wherein the body is constructed of a aluminum material resistant to wear and corrosion.

13. A method of deck construction using a deck fasteners alignment tool comprising:

providing a deck fasteners alignment tool that includes a body having (a) opposed ends, (b) an upper edge and a lower edge extending between said opposed ends, and (c) a front face and a rear face opposite and parallel to said front face such that said body has a generally rectangular and planar configuration; and aligning said body by interfacing a pair of laterally opposed alignment pins that extend rearwardly from said rear face with laterally adjacent decking gaps that are defined by adjacent decking boards until contact is made with a deck joist; and wherein said upper edge of said body defines a pair of V-shaped notches, each notch being configured to align and guide insertion of deck board screws into respective deck boards.

14. The method as in claim 13 further comprising mounting a pair of neodymium magnets in an interior area of the body, each magnet being positioned proximate to one of said notches and configured to magnetically hold deck board screws in an upright configuration.

15. The method as in claim 14, wherein:

said pair of notches each includes a pair of descending edges that intersect to define a convergent area; and said pair of neodymium magnets are mounted adjacent said convergent areas defined by said notch members, respectively.

16. The method as in claim 14, wherein said body defines a pair of pockets between said front and rear faces, said pair of neodymium magnets being removably received in said pair of pockets, respectively.

17. The method as in claim 14, wherein said pair of neodymium magnets are positioned at an angle within the body so as to maximize magnetic attraction upon respective deck fasteners.

18. The method as in claim 13, wherein:

said body includes a bridge extending between said opposed ends and that defines a slot having a linear configuration; and said deck fasteners alignment tool includes a pair of V-shaped notches each being coupled to said bridge and being slidably and laterally movable along said slot.

* * * * *